US005937685A

United States Patent [19]

Matsuoka et al.

[11] Patent Number: 5,937,685

[45] Date of Patent: Aug. 17, 1999

[54] METHOD AND APPARATUS FOR LINEAR SPRING

[75] Inventors: Takeji Matsuoka; Hiroshi Okubo, both of Kawaguchi, Japan

[73] Assignee: MEC Machinery Co., Ltd., Kawaguchi, Japan

[21] Appl. No.: 08/893,511

[22] Filed: Jul. 11, 1997

[30] Foreign Application Priority Data

Jul. 17, 1996 [JP] Japan ..... 8-205451

[51] Int. Cl.[6] ..... B21F 35/02; B21F 3/04; B21J 13/00

[52] U.S. Cl. ..... 72/137; 72/140; 72/145; 72/446

[58] Field of Search ..... 72/137, 138, 135, 72/140, 145, 142, 446, 447, 429

[56] References Cited

U.S. PATENT DOCUMENTS

| | | | |
|---|---|---|---|
| 4,947,670 | 8/1990 | Wu | 72/137 |
| 5,452,598 | 9/1995 | Cheng | 72/137 |
| 5,732,583 | 3/1998 | Itaya | 72/137 |

*Primary Examiner*—Joseph J. Hail, III
*Assistant Examiner*—Rodney Butler
*Attorney, Agent, or Firm*—Oblon, Spivak, McClelland, Maier & Neustadt, P.C.

[57] ABSTRACT

A method and apparatus are provided for forming the linear springs. In the apparatus three or more forming tools are arranged radially about the center of the quill for guiding the linear material are rotated within a predetermined angle about the centerline of the quill and are simultaneously advanced in the extension direction of the centerline of the quill perpendicular or substantially perpendicular to the centerline of the quill of the quill and collided against the linear material fed from the tip end portion of the quill to thereby always perform the formation of the linear spring, the apparatus being suitable for embodying this method is provided. The method is characterized by: rotating a turntable, on which the forming tools are mounted, about the centerline of the quill so that a linear material contact surface of at least one, as desired, of the forming tool is located in a direction which is suitable for the formation of the linear material; and after the rotating, advancing the forming tool, as desired, in the extension direction of the centerline through an associated one of a number of driving means, the number being more than the number of the forming tools arranged, disposed radially about the centerline of the quill outside of the turntable for forming the linear spring. It is possible to rotate the quill about the centerline of the quill.

8 Claims, 16 Drawing Sheets

METHOD AND APPARATUS FOR LINEAR SPRING

BACKGROUND OF THE INVENTION

The present invention relates to a method for producing a linear spring by simultaneously advancing desired two or more forming tools perpendicular or substantially perpendicular to a centerline of a quill in an extension direction of the centerline of the quill and colliding them against a linear material fed from a tip end portion of the quill under the condition that three or more forming tools arranged radially about the centerline of the guide for guiding the linear material are swivelled through a desired angle about the centerline of the quill, and relates also to an apparatus that is suitable for embodying this method.

Linear springs are categorized into a variety of coil springs such as a compressive coil spring, a tension coil spring, a twist coil spring or the like, and a linear worked spring that has no coil portion. Except for the compressive coil spring, in general, these linear coil springs are formed into a complicated shape having hooks in various directions and portions bent at various angle. Recently, the variety of coil springs have to be produced in a single linear spring forming apparatus.

Examples of the conventional linear spring forming apparatus that meets such a requirement are shown in Japanese Patent Application Laid-Open No. 144542/1984 entitled "METHOD FOR CONTROLLING FORMING TOOLS IN A LINEAR MATERIAL BENDING AND FORMING MACHINE", Japanese Patent Publication No. 2296/1994 entitled "SPRING FORMING METHOD AND APPARATUS", or the like.

The apparatus disclosed in the above-described Japanese Patent Application Laid-Open No. 144542/1984 relates to a system in which two or more forming tools which are arranged at predetermined radial position about the center of a quill are advanced perpendicular or substantially perpendicular right angle relative to a centerline of the quill in an extension direction of the centerline of the quill and collided against a linear material fed from a tip end portion of the quill, by the rotation of a cam driven by a plurality of motors whose rotational speed may be controlled. Each forming tool is fixed in an arrangement position relative to the quill. As a result, in some cases, it is impossible to advance the optimum forming tool in the extension direction of the centerline of the quill from the optimum direction even if the linear material is bent in a desired direction. Accordingly, in order to bend the material, it is necessary to prepare forming tools having a variety of special shapes for advancing the forming tools in the extension direction of the centerline of the quill from a different direction which is not on the extension line of the optimum direction for bending the linear material. Also, even if the forming tools in such a variety of special shapes would be prepared, in some cases, it is impossible to bend the linear material in a desired direction. The conventional method suffers from such a problem.

On the other hand, the apparatus disclosed in the above-described Japanese Patent Publication No. 2296/1994 relates to a system in which a single forming tool disposed in confronting relation with the extension line side of the centerline of the quill is swivelled about the centerline of the quill, and is brought into abutment with the linear material fed from the tip end portion of the quill to form the linear spring. Since all the forming are carried out by the single forming tool, there is no problem in forming of a larger coil portion having a long radius of curvature. However, in case of the bending forming step in which the radius of the curvature of the hook portion is short, as shown in FIG. 19, an edge at the linear material outlet of the tip end portion of the quill has to be utilized. Accordingly, in order not to produce a fault in the linear material, the line material has to be fed finely in conformity with a timing or time when the tool is advanced in the direction toward the tip end of the quill and is brought into contact with the linear material and to have a bent angle by increasing and decreasing a feed amount. Accordingly, it is necessary to keep the radius of curvature for the bending two to three times or more of the diameter of the linear material. In addition, such a bending forming method has to be carried out. In many cases, not only a precision of the bent angle is inferior but also the production speed has to be set at a low level. Moreover, in the case where the linear material is bent and formed with a short radius of curvature along the edge of the quill in forming, an increased pressure is applied to the linear material. Accordingly, it is impossible to avoid the fault in the linear material caused by a friction due to the contact between the quill and the edge. As a result, the conventional system always suffers from a serious problem in quality, and at the same time, a fatal default that it is impossible to form a bend having a very short radius of curvature in view of the quality requirement.

Also, in the apparatus disclosed in the above-described Japanese Patent Publication No. 2296/1994, unless there is formed a substantially semicircular shape which has no portion corresponding to half an upper portion in the tip end of the quill as shown in FIG. 20 for the forming of the coil portion, it is impossible to form the coil portion which is similar to a high density winding. The peripheral portion at the outlet of the linear material has to take a structure that is very thin in thickness. Accordingly, except for the case of an extremely thin linear material, not only it is necessary to avoid a fear of a damage of the quill in forming in this direction, but also in some cases, since the cutting tool for the linear material is fixed in position, it is impossible to cut the linear material after the forming operation depending upon a shape of the products which have been produced. Accordingly, for these reason, in some cases, the forming has to be given up. Thus, there are many disadvantages in the conventional system.

There is the following fatal defect in the case where such a structure for swivelling the forming tool about the centerline of the quill whenever the linear material is bent. As described above, since the forming tool is disposed on the extension line side of the centerline of the quill, it is impossible to set a plurality of forming tools. Accordingly, when the linear material is bent in a desired direction, it is impossible to use a plurality of forming tool-suitable for such bends. Thus, it is impossible to perform the forming of the variety of linear springs due to the limit to be caused to shapes otherwise feasible.

Also, an apparatus has been recently on the market in which the arrangement position of the forming tools arranged radially about the quill may be adjusted in position by a manual work. However, in such an apparatus, an interval (i.e., an angle) between the adjacent forming tools is limited to about 15° due to factors in structure of the slide guide for supporting and operating the forming tools. In addition, once the arrangement position of the forming tools is moved and adjusted by the manual work, the apparatus is used in a fixed position of the forming tools at the set position. Accordingly, there is no difference from the position of the forming tools in the case where a single kind of the products are produced. There is no improvement in the fault that it is impossible to advance the optimum forming tool at a right angle or substantially a right angle relative to the centerline of the quill in the extension line direction of the centerline of the quill always from an optimum direction in forming the linear springs. Then, in the case where the displacement between the direction (angle) in forming the linear material and the direction in which the forming tool may be advanced is large, it is impossible to perform the forming operation. In case of the small displacement, the tool to be collided against the linear material and the special unit having a power source such as an air cylinder or the like is forcibly pushed against the forming portion just before the forming or the forming portion during the forming operation, whereby a desired forming direction (angle) is kept by twisting the linear material. This is a currently performed method. However, since the forming operation is carried out while twisting the linear material in this way, the maintenance of the forming precision is very unstable, and it takes a long time for the preparation work. In addition, although it is possible to form the linear springs having a shape to some extent, the production speed has to be reduced in view of the alignment of timing with the twist of the linear material by utilizing the air cylinder as a power source as described above and further the maintenance of the sufficient forming precision, such being the current situation.

Furthermore, in producing the linear springs, not only a mass production but also a production of a prototype or a very small amount of the production is required for various linear springs. In the case where such a small amount of the production for various linear springs is carried out, since exactly the same arrangement and kind of the forming tools and the auxiliary means for the mass production are required, the number of the kinds of the forming tools is very much increased.

However, if it is possible to the optimum forming tool from the optimum direction in the direction perpendicular or substantially perpendicular to the centerline of the quill in the extension direction of the quill, it is possible not only to reduce the number of the forming tools and to readily perform the preparation, but also to solve problems of the increase in the cost entailing from preparation of a variety of forming tools and the management thereof. However, in any type of the conventional linear spring forming apparatus, when the linear springs having various shapes are formed, there is the defect that it is impossible to advance the optimum forming tool from the optimum direction in the direction perpendicular or substantially perpendicular to the centerline of the quill in the extension line direction of the centerline of the quill. Accordingly, it is impossible to solve the cost problem and troublesome management problem.

SUMMARY OF THE INVENTION

In order to overcome the defects inherent in the conventional linear spring forming apparatus as described above, even under the condition that three or more forming tools arranged radially about the center of the quill for guiding the linear material are rotated within a predetermined angle about the centerline of the quill, there is provided a method for forming the linear spring, wherein two or more desired forming tools are simultaneously advanced in the extension direction of the centerline of the quill perpendicular or substantially perpendicular to the centerline of the quill and collided against the linear material fed from the tip end portion of the quill to thereby always perform continuously formation of the linear spring. Also, an apparatus suitable for embodying this method is provided.

According to the present invention, there is provided a method for forming a linear spring, including the steps of: advancing three or more forming tolls, arranged radially about a centerline of a quill for guiding a linear material, in an extension direction of the centerline of the quill, perpendicular or substantially perpendicular to the centerline of the quill, and colliding the forming tools to the linear material fed from a tip end portion of the quill, the method characterized by comprising the following steps of:

rotating a turntable, on which the forming tools are mounted, about the centerline of the quill so that a linear material contact surface of at least one, as desired, of the forming tool is located in a direction which is suitable for the formation of the linear material; and after the rotating, advancing the forming tool, as desired, in the extension direction of the centerline through an associated one of a number of driving means, the number being more than the number of the forming tools arranged, disposed radially about the centerline of the quill outside of the turntable for forming the linear spring.

In such a method, if the quill is rotated about the centerline of the quill, the number of the kinds of the linear springs to be produced is increased, and it is possible to further shorten the period of time for forming the linear spring by feeding the linear material from the tip end portion of the quill during the steps for rotating the turntable, on which the forming tools are mounted respectively, about the centerline of the quill and positioning a linear contact surface of the desired one or plural forming tools in a direction suitable for the formation of the linear material.

According to another aspect of the invention, there is provided an apparatus for forming a linear spring, in which three or more forming tolls, arranged radially about a centerline of a quill for guiding a linear material, are advanced in an extension direction of the centerline of the quill, perpendicular or substantially perpendicular to the centerline of the quill, and the forming tools are collided against the linear material fed from a tip end portion of the quill, the apparatus characterized by comprising:

a first drive means for rotating a turntable, to which are fixed respective track rails for slidingly advancing and retracting slide units, having the forming tools, in the extension direction of the centerline of the quill, perpendicular or substantially perpendicular to the centerline of the quill;

a number of second drive means, the number being equal to or greater than the number of the slide units, the second drive means being disposed radially about the centerline of the quill outside of the turntable for advancing and retracting the desired slide units in the extension direction of the centerline of the quill; and a third drive means for feeding the linear material from the tip end portion of the quill;

wherein the first drive means and the second rive means are controlled in synchronism with the third drive means.

In such a linear spring forming apparatus, if the quill is supported rotatable about the centerline of the quill, and is switchable between a case where the quill is fixed through a coupling member in an unrotatable condition and a case where the quill is coupled with the turntable through another coupling member to be rotated together with the turntable, the kinds of the linear springs to be made is increased. Also, if a drive source for the second drive means is located outside of the turntable, and is mounted on a drive source mounting table that is rotatable within a predetermined angle range about the centerline of the quill, it is possible to maintain the drive source of the second drive means to a suitable position in correspondence with the linear spring to be formed. If the second drive means is provided with an arcuate cam that may be advanced and retracted in the extension direction of the centerline of the quill, and a center of curvature of an inner surface of the arcuate cam is set substantially on the centerline of the quill when a cam follower provided in the slide unit is moved closest to the quill under the condition the cam follower is brought into contact with the inner surface of the arcuate cam, it is possible to bring the forming tools immediately to the position that the tools may be advanced, when the turntable is rotated about the centerline of the quill and stopped at the rotation position. If the arcuate cam may be spliced at its end portion with an auxiliary cam, it is possible to further broaden the rotational range of the turntable into the position where the forming tools are immediately brought to the advanced position.

DESCRIPTION OF THE PREFERRED EMBODIMENTS

The present invention will now be described with reference to the accompanying drawings.

Figure 5:
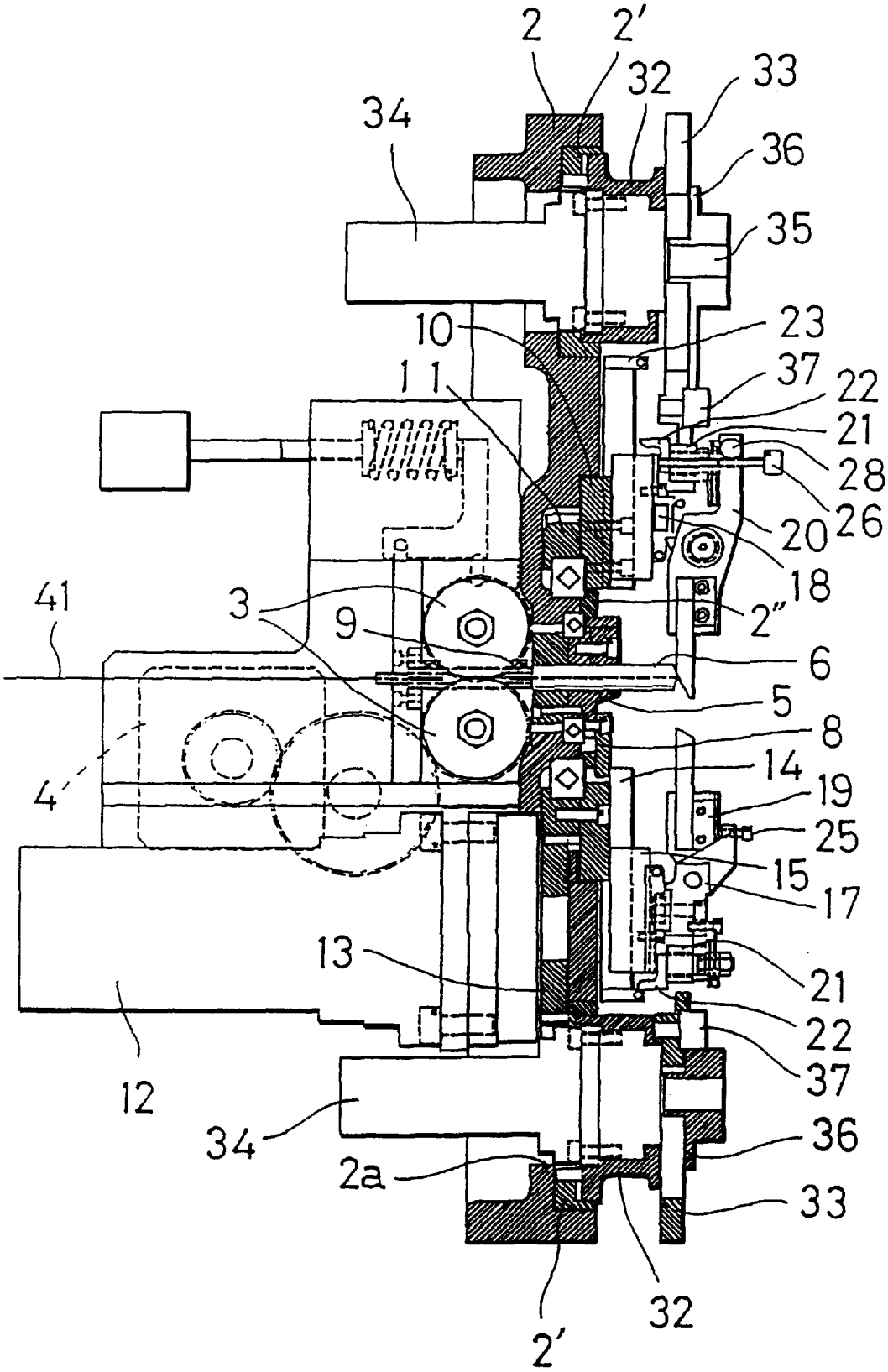
FIG. 5 is a side elevational cross-sectional illustrative view taken along a center of FIG. 4.

In the drawings, a support base 1 supports an upper base 2 on its top portion and incorporates a multi-axis numerical controlling unit (i.e., a 10 axis numerical controlling unit because eight slide units are used in the embodiment shown) for positioning and driving servo motors (i.e., a pair of pressure feeding roller drive servo motors for pressure-feeding a linear material to be described later, a servo motor for swivelling and driving a turntable to be described later, and a servo motor for forwarding and retracting a slide unit to be described later). All the servo motors (10 motors in the embodiment shown) and mechanical elements for forming a linear spring are mounted on the upper base 2. Reference numeral 3 denotes a pair of pressure feeding rollers constituting a third drive means for pressure-feeding the linear material 41 as shown in FIG. 5. The pair of pressure rollers 3 is driven by a gear train that is engaged with a gear fixed to a drive shaft of a servo motor 4 for pressure-feeding the linear material 41 to a quill 6 (guide for the linear material 41) to be described later by a predetermined length.

Figure 6A:
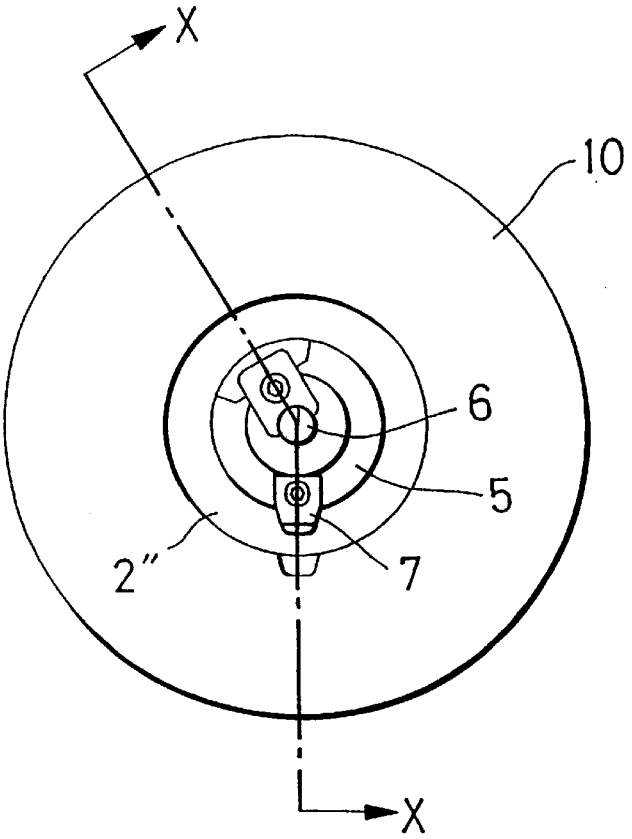
FIG. 6A is a frontal view showing a state where a quill is fixed in place.
Figure 6B:
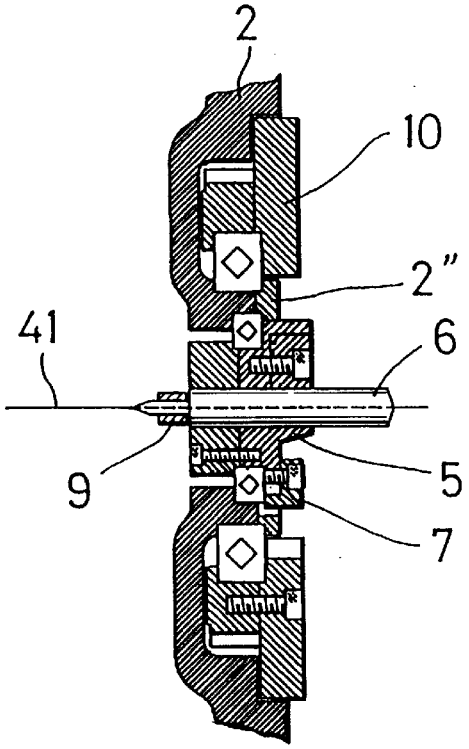
FIG. 6B is a cross-sectional view taken along the line X—X of FIG. 6A.
Figure 7A:
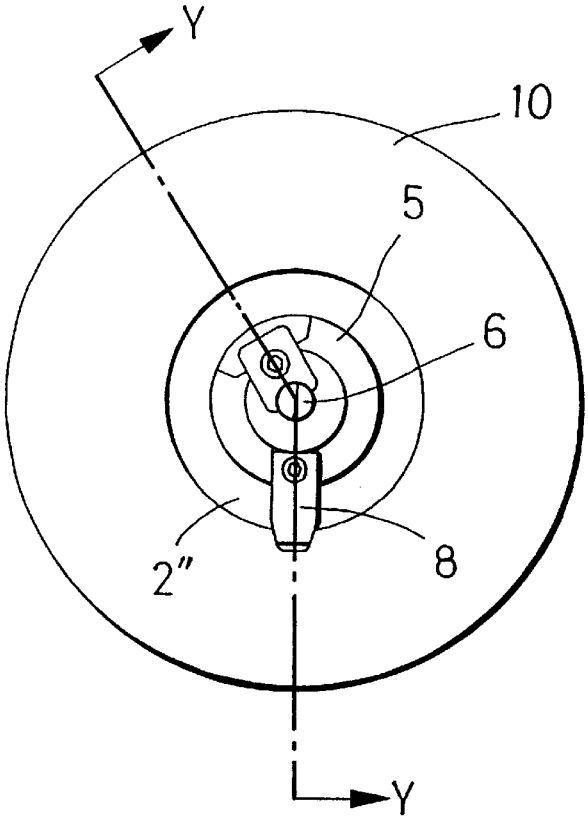
FIG. 7A is a frontal view showing a case where the quill is movable in cooperation with the turntable.
Figure 7B:
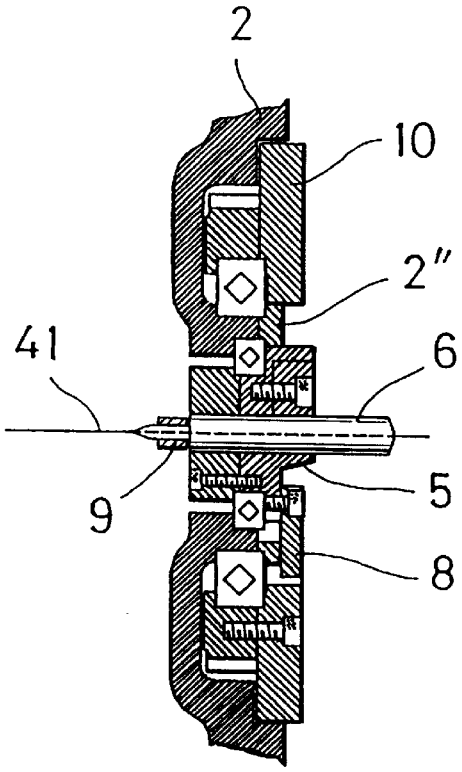
FIG. 7B is a cross-sectional view taken along the line Y—Y of FIG. 7A.

Reference numeral 5 denotes a mandrel rotatably supported through a cross roller bearing to the upper base 2 as shown in FIGS. 5, 6A, 6B, 7A and 7B. The quill 6 is detachably fixed to a center of the mandrel 5. Accordingly, the quill 6 is rotatable about a centerline of a through hole for the linear material 41, i.e., the centerline of the quill 6. There are two cases where the quill 6 is fixed to a bearing retainer ring 2" fixed to the upper base 2 through a coupling member 7 and used in an unrotatable condition as shown in FIGS. 6A and 6B, and the quill 6 is coupled with the turntable 10 (to be described later) through a coupling member 8 and used to be rotated together with the turntable 10 as shown in FIGS. 7A and 7B.

Figure 3:
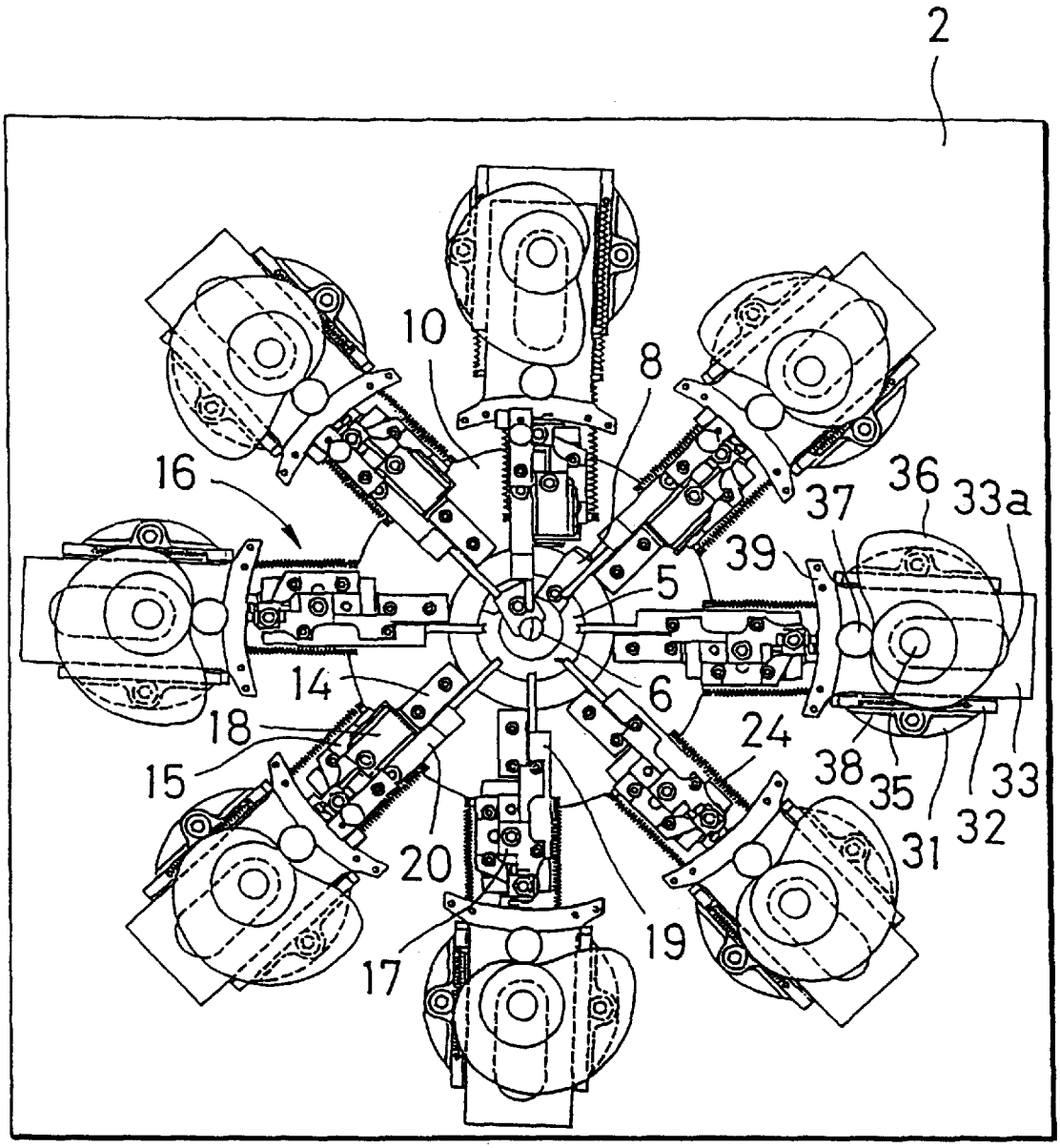
FIG. 3 is a frontal view showing an upper base thereof.

Reference numeral 9 denotes an intermediate quill fixed to the upper base 2. The linear material 41 is guided to the quill 6 by the pressure feeding rollers 3 through the intermediate quill 9, and fed to the front face of the apparatus according to the invention to be formed into the linear spring. Reference numeral 10 denotes a turntable rotatably supported to the upper base 2 through the cross roller bearing about the centerline of the quill 6. As shown in FIG. 5, the turntable 10 is swivelled about the centerline of the quill 6 through a ring gear 11 that is engaged with a gear 13 fixed to an output shaft of the servo motor 12 that constitutes a first drive means and is positioned and driven at a predetermined turn position. As shown in FIG. 3, the slide units 15 of more than three (eight in the embodiment shown) ball type linear ways 16 which are constituted of track rails 14 and the slide units 15 are radially arranged and fixed to the top surface of the turntable 10 so that the sliding direction of the track rails 14 is perpendicular to the centerline of the quill 6 in the extension direction of the quill 6.

In each linear way 16, hereinafter, the "front portion" means the side toward the quill 6, the "rear portion" means the opposite outer side thereto, the "forward movement" means that the slide unit 15 is slidingly moved to the front portion, and the backward movement means that the slide unit 15 is slidingly moved to the rear portion on the opposite side. In this embodiment, a support and adjustment mechanism for the forming tool to be mounted on the slide unit 15 of the linear way 16 to be described next is operated in two ways. However, either operational mode is based on the conventional technology; and therefore, only the basic structure will be described.

As shown in FIG. 3, support members 17 and 18 are adjustable in position right and left to the sliding direction of the slide unit 15 and detachably fixed by screws. The support members 17 and 18 support tool support arms 19 and 20 (to be described later) at the front portion together as shown in FIG. 5. A cam follower 21 is provided at the rear end portion adjustably back and forth. An L-shaped contact piece 22 formed integrally with the shaft of the cam follower 21 is brought into contact with a stopper 23 provided at the rear end portion of the above-described track rail 14 to thereby determine an initial position of the slide unit 15. As shown in FIG. 3, reference numeral 24 denotes tension coil springs for attracting the slide unit 15 to the rear portion.

Figure 8:
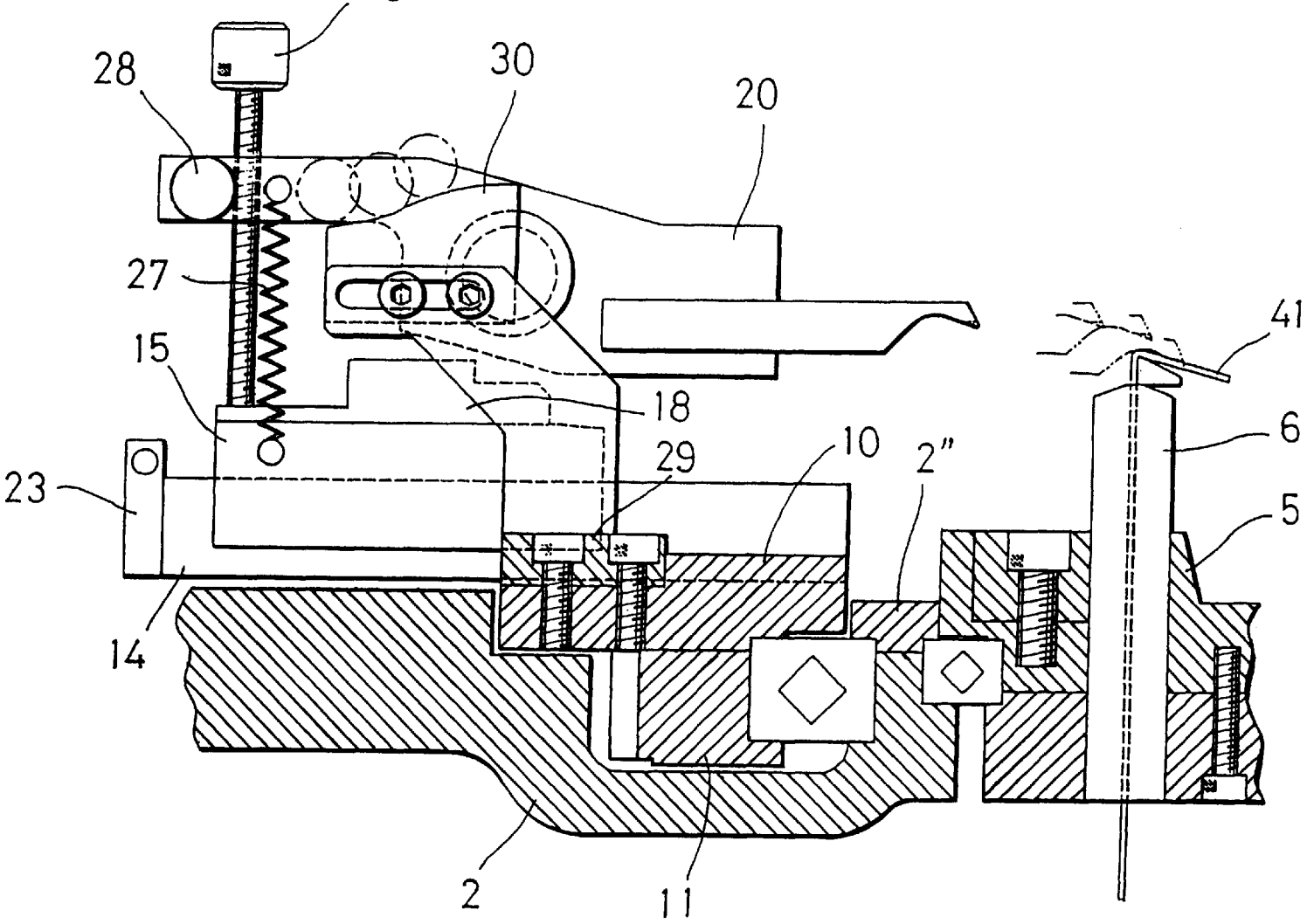
FIG. 8 is an enlarged illustrative view showing a cooperation between a tool support arm and a plain cam.

As shown in FIG. 5, the tool support arm 19 is supported slidably to the support member 17 in parallel with the sliding direction of the slide unit 15. Also, as shown in FIG. 8, the tool support arm 20 is supported slidably on the surface side of the upper base 2 in parallel with the sliding direction of the slide unit 15. For forming tools (such as a coil forming tool, a cutting tool, a receiver tool, a centering tool and the like) which are fastened by screws at a tip end portion of the tool support arm 19, an interval between their linear material contact surface and the end face of the quill 6 may be adjusted by adjustment screws 25.

A bending tool (sometimes a coil forming tool) is mainly fastened by screws at the tip end portion of the tool support arm 20. As shown in FIG. 8, an interval between the end face of the quill 6 and the bending tool may be adjusted by an adjustment screw 26. Reference numeral 27 denotes a tension coil spring for applying a load to the adjustment screw 26. On the other hand, as shown in FIGS. 5 and 8, a cam follower 28 is fixed to the rear portion of the tool support arm 20. When the linear material 41 is bent by using the bending tool, the cam follower 28 is brought into contact with a plain cam 30 fastened by screws adjustably in position to a bracket 29 provided on the turntable 10 just before the completion of the forward movement of the slide unit 15, so that the linear material 41 is pushed toward the quill 6 and bent at a predetermined angle by utilizing the receiver tool which has been advanced on time.

Figure 2:
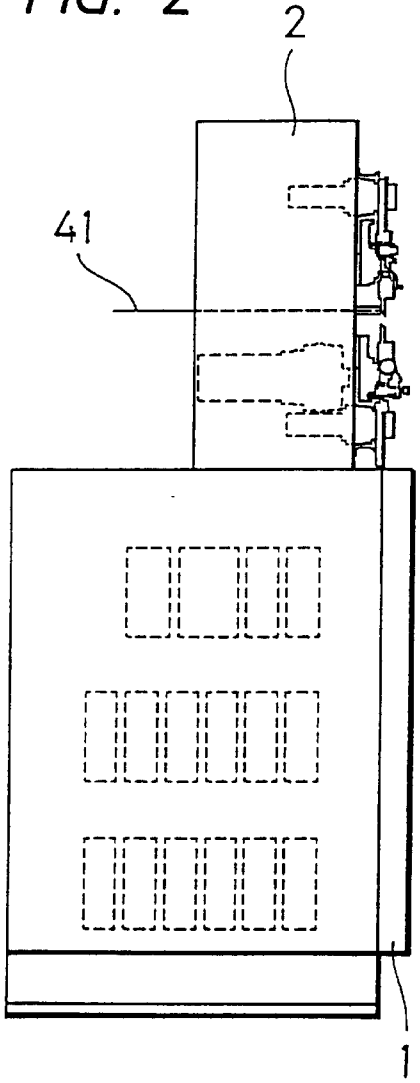
FIG. 2 is a left side elevational view thereof.
Figure 1:
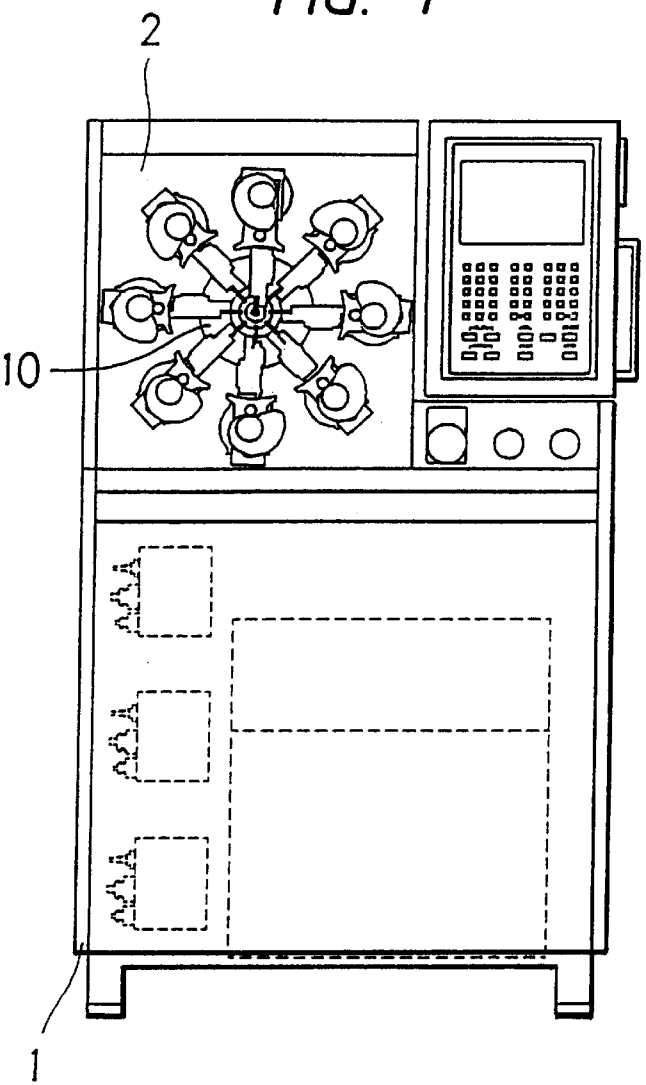
FIG. 1 is an entire frontal view showing an apparatus for forming a linear spring in accordance with an embodiment of the invention.
Figure 4:
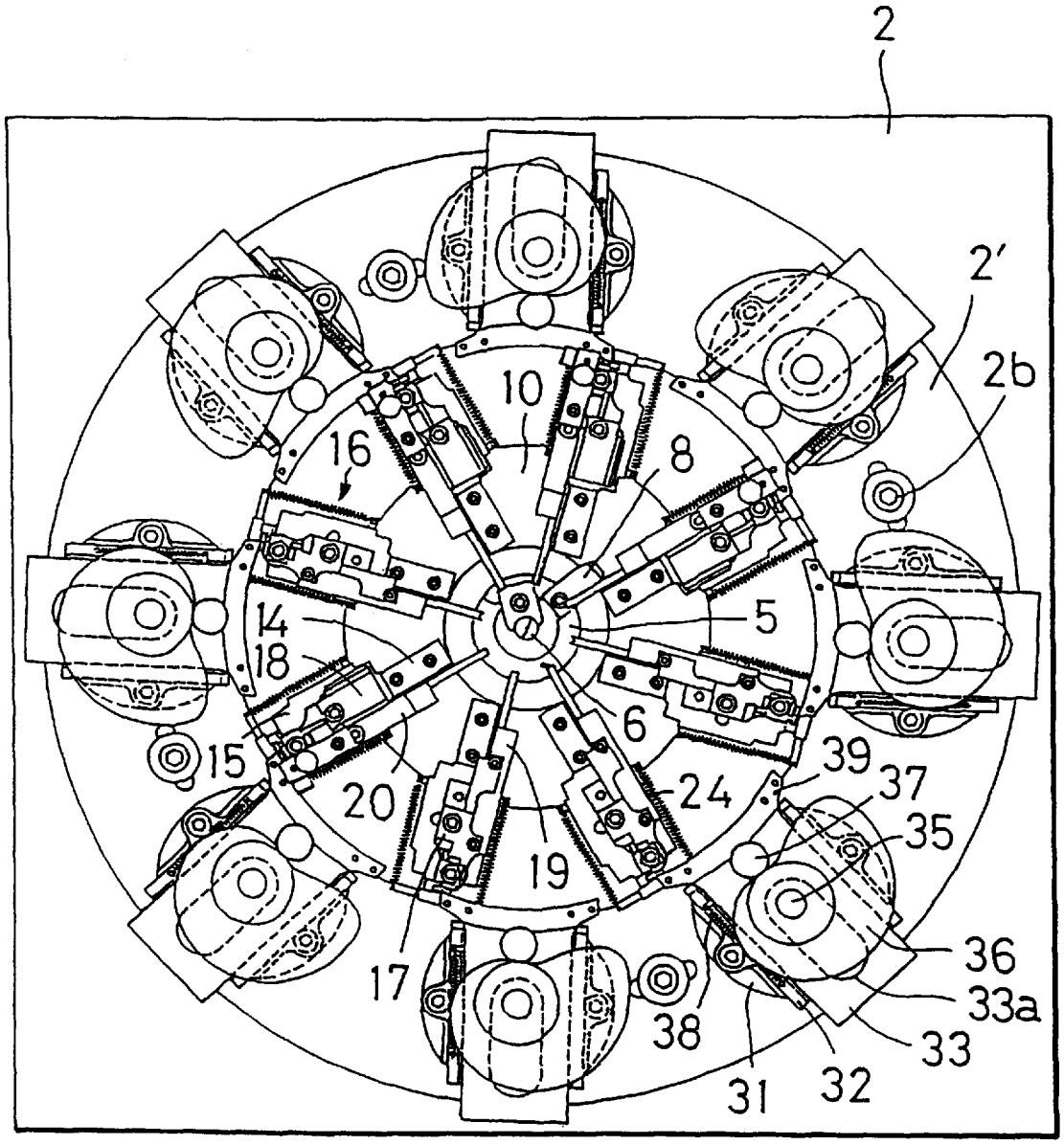
FIG. 4 is a frontal view showing an upper base thereof provided with a drive source mounting table that is rotatable within a predetermined angle under the condition that a turntable is rotated.

As shown in FIGS. 1, 3 and 4, the number (which is equal to or larger than the number of the slide units 15) of arcuate cam units 31 are radially arranged and mounted on the outer peripheral portion of the above-described turntable 10, respectively, about the quill 6 to the upper base 2 or a drive source mounting table 2' that is rotatable within a predetermined angle range about the centerline of the quill 6 fixed to the upper base 2 by nuts **2*b* and that has arcuate elongated holes, about the centerline of the quill 6, through which bolts implanted in the upper base are caused to pass, for forwarding and retracting the slide units 15 in the extension direction of the centerline of the quill 6. Reference numeral 32 denotes a slide guide for supporting the entire arcuate cam unit 31. As shown in FIG. 5, the sliding direction is directed to the centerline of the quill 6 and a slide plate 33 is slidably mounted. Reference numeral 34 denotes a servo motor which constitute a second drive means for forwarding, retracting, positioning and driving the slide plate 33. The servo motor 34 is fastened by screws in the interior of the slide guide 32 through the hole 2*a* formed in the upper base 2 or the drive source mounting table 2' mounted on the upper base 2 as shown in FIG. 5. A tension coil spring 38 is laid at one end to the slide plate 33 and at the other end to the slide guide 32 so that, as shown in FIGS. 3 and 4, a cam follower 37 fastened by screws on the quill 6 side of the slide plate 33 is constantly in contact with a cam 36 fixed to an output shaft 35 of the servo motor 34 projecting to the front face from the elongated hole 33*a* formed in the slide plate 33**.

Furthermore, as shown in FIGS. 3 and 4, an arcuate cam 39 is provided at the tip end, on the quill 6 side, of the slide plate 33 with its inner arcuate surface **39*a* facing the quill 6. When the said cam follower 37 is located on a basic circle of cam 36 (a portion where a distance from the center of the output shaft 35 of the servo motor 34 is at minimum) (hereinafter referred to as a base point), the inner arcuate surface 39*a* of the arcuate cam 39 faces, through a minute gap, a swivel orbit of the cam follower 21 for the support members 17 and 18 when the slide unit 15 is located at the said initial position. The cam follower 21 of the linear way 16 positioned in angular position at a predetermined angle by the rotation of the turntable 10 is pushed against the inner surface 39*a* of the arcuate cam 39 in accordance with the rotation of the cam 36 driven by the servo motor 34. The slide unit 15 is advanced to the reference position where it is most advanced toward the quill 6. The forming tool is brought into abutment with the linear material 41 fed from the tip end of the quill 6**, thereby forming the linear spring.

Figure 9A:
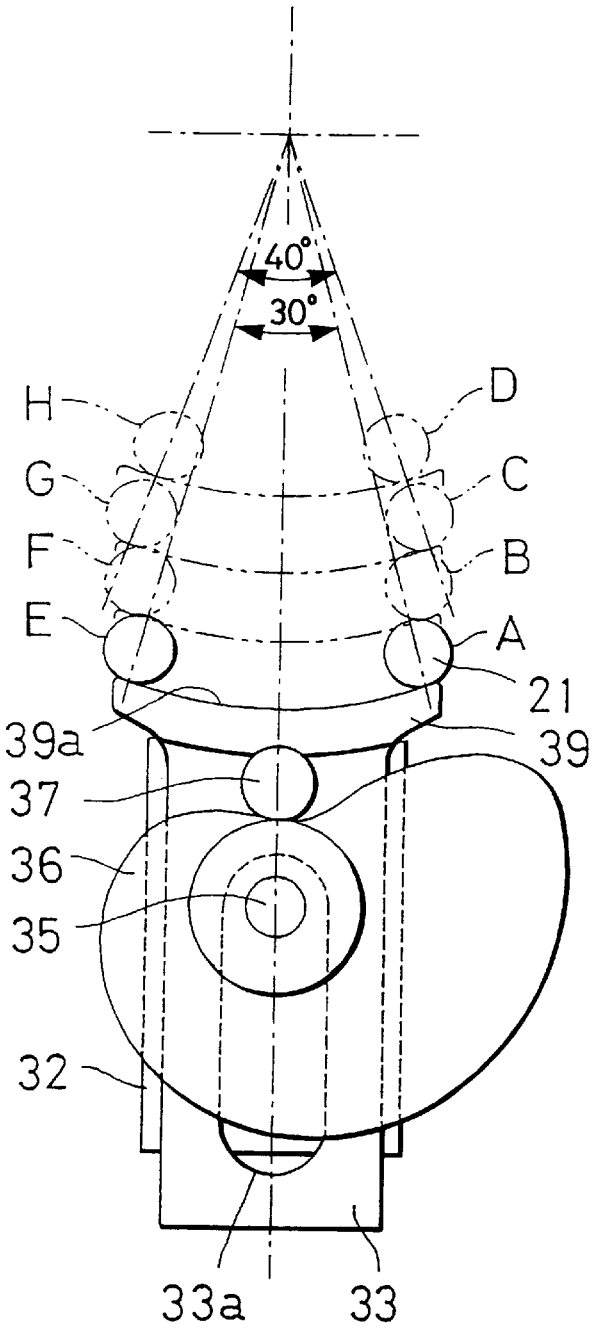
FIG. 9A is an illustration showing a case where a cam is located in a base point in relation between an arcuate cam and a cam follower of a linear way.
Figure 9B:
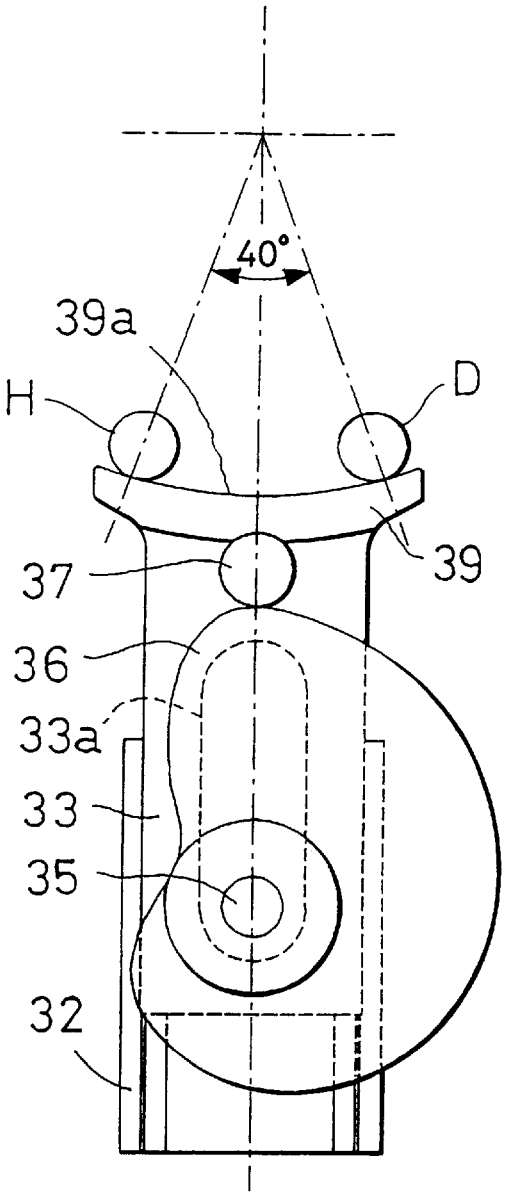
FIG. 9B is an illustration showing a case where the cam is rotated so that the arcuate cam has advanced to a standard position.

In this case, in the embodiment shown, the inner surface **39*a* of the arcuate cam 39 is designed so that its curvature center is identical with the centerline of the quill 6 at the position of the arcuate cam 39 when the slide unit 15 is advanced to the reference position. The angle where the linear way 16 may be operated by the arcuate cam 39 is set within 40° in the embodiment as shown in FIGS. 9A and 9B. The inner surface 39*a* is determined so that the advanced position of the forming tool advanced to the reference position is kept unchanged in any angle for the position of the linear way 16 rotated and positioned in this range. On the other hand, in the case where the cam follower 37 is positioned at the said base point, in the embodiment shown, the angle through which the linear way 16 may be operated by the arcuate cam 39 is within 30°. In the case where the direction, i.e., angle for forming the linear material 41 is out of the angle 30° where the arcuate cam 39** is available, the following method will be taken.

FIGS. 9A and 9B are illustrations of the operation and show a time basis for the operation of the cam follower 21 on the linear way 16. The cam follower 21 provided at the slide unit 15 of the ball type linear way 16 fixed to the top surface of the turntable 10 to be rotated and positioned, through the ring gear 11 that is engaged with the gear 13 fixed to the output shaft, by the power driving motion of the servo motor 12 of the first drive means is temporarily stopped in position A which is one end portion of the inner surface **39*a* of the arcuate cam 39 by rotating the turntable 10 by the driving motion of the servo motor 12. Subsequently, as shown in FIG. 9(B), the cam follower 37** fastened by screws to the slide plate 33 is pushed by the cam 36 rotated by the driving motion of the servo motor 34 of the second drive means, so that the slide plate 33 is advanced along the elongated hole 33*a* to thereby start the forward motion of the arcuate cam 39. At the same time, the servo motor 12 is driven to rotate the turntable 10 so that the condition where the cam follower 21 is kept in contact with one end portion of the inner surface 39*a* of the arcuate cam 39. The cam follower 21 reaches a position C which is at a predetermined position through a position B. The advance of the arcuate cam 39 is continued so that the cam follower 21 is linearly forwarded to a predetermined position D to thereby complete the formation of the linear material 41.

Otherwise, the cam follower 21 provided at the slide unit 15 of the ball type linear way 16 mounted on the surface of the turntable 10 to be rotated and positioned through the ring gear 11 engaged with the gear 13 fixed to the output shaft by the driving motion of the servo motor 12 of the first drive means is temporarily stopped at a position E which is the other end of the inner surface 39*a* of the arcuate cam 39 by rotating the turntable 10 by the driving motion of the servo motor 12. Subsequently, as shown in FIG. 9(B), the cam follower 37 fastened by screws to the slide plate 33 is pushed by the cam 36 rotated by the driving motion of the servo motor 34 of the second drive means, and the slide plate 33 is advanced along the elongated hole 33*a* to thereby start the advance of the arcuate cam 39. At the same time, the servo motor 12 is driven and the turntable 10 is rotated so that the cam follower 21 is kept in contact with one end portion of the inner surface 39*a* of the arcuate cam 39. The cam follower 21 reaches a position G which is at a predetermined position through a position F. The advance of the arcuate cam 39 is continued so that the cam follower 21 is linearly forwarded to a predetermined position H to thereby complete the formation of the linear material 41.

The relative operations after the formation such as retraction of the slide unit 15 and swivel of the linear way 16 are performed in the completely opposite order to the case of the advancement of the forming tools. These operations may be adjusted with ease by a multi-axis numerical control.

Figure 10:
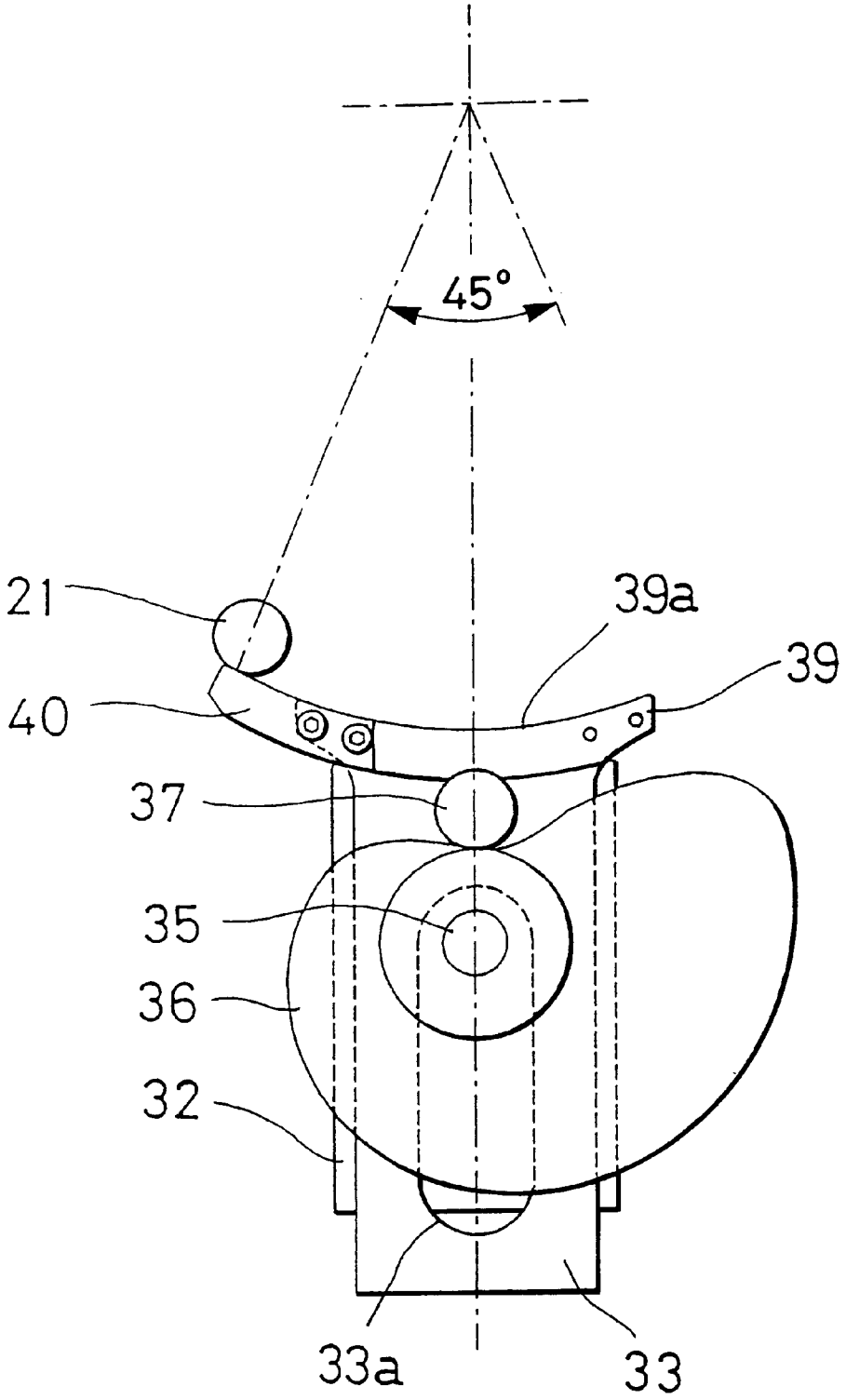
FIG. 10 is an illustration showing a relationship in the case where the auxiliary cam is mounted on the arcuate cam.

The operation of the arcuate cam 39 up to 40° has been explained above. However, in many cases, the operation up to 30° may be sufficient. In very rare cases where the necessary angle would exceed 40° and reach 45°, as shown in FIGS. 4 and 5, the drive source mounting table 2' which is rotatable within a predetermined angle about the centerline of the quill 6 outside of the turntable 10 and fixed to the upper base 6 by nuts 2*b* is rotated through the predetermined angle in advance. Otherwise, as shown in FIG. 10, an auxiliary cam 40 is spliced to the end portion of the arcuate cam 39. In the case where the auxiliary cam 40 is spliced to the end portion of the arcuate cam 39, the relative operations of the linear way 16 and the arcuate cam 39 may be performed in the same method as explained above in conjunction with FIGS. 9A and 9B.

The advancement and retraction of the forming tool according to the present invention have been explained above. The rotational positioning drive operation of the linear way 16 by the servo motor 12 of the first drive means, the advancement and retraction positioning drive operation of the arcuate cam 39 by the servo motor 34 of the second drive means and the rotational positioning drive operation of the pressure feed rollers for feeding the linear material 41 by the servo motor 4 of the third drive means are performed in synchronism with each other by the multi-axis numerical unit in the embodiment shown, herein.

The operation of various kinds of tools will be explained as to two kinds of linear springs in order to further clarify the description of the overall apparatus.

Figure 11:
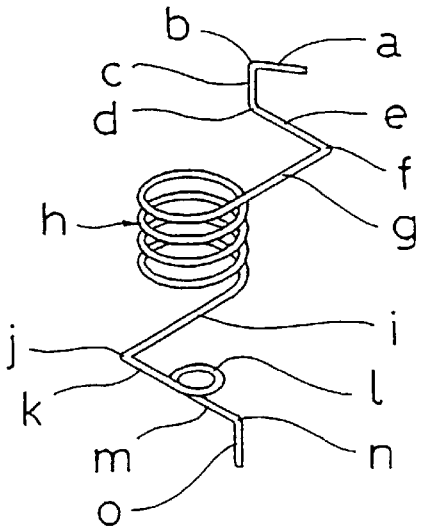
FIG. 11 is a perspective view showing one example of a linear spring to be formed by the apparatus according to the invention.
Figure 12:
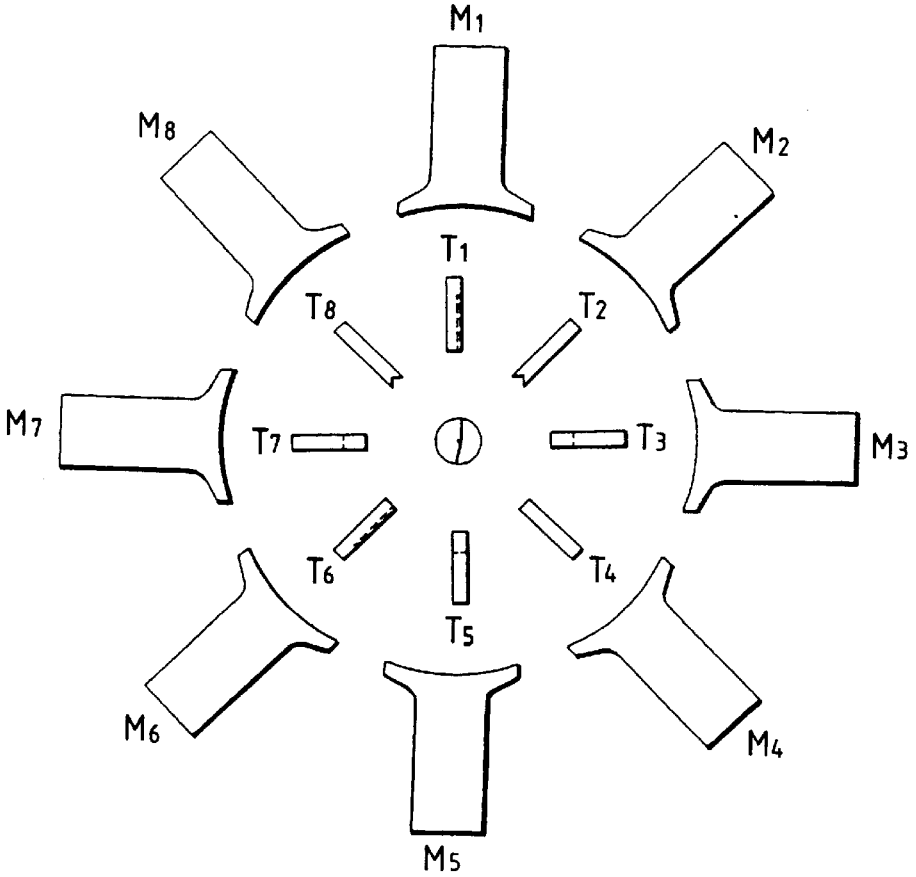
FIG. 12 is a view showing an arrangement of the forming tools before the formation of the linear spring shown in FIG. 11.
Figure 13:
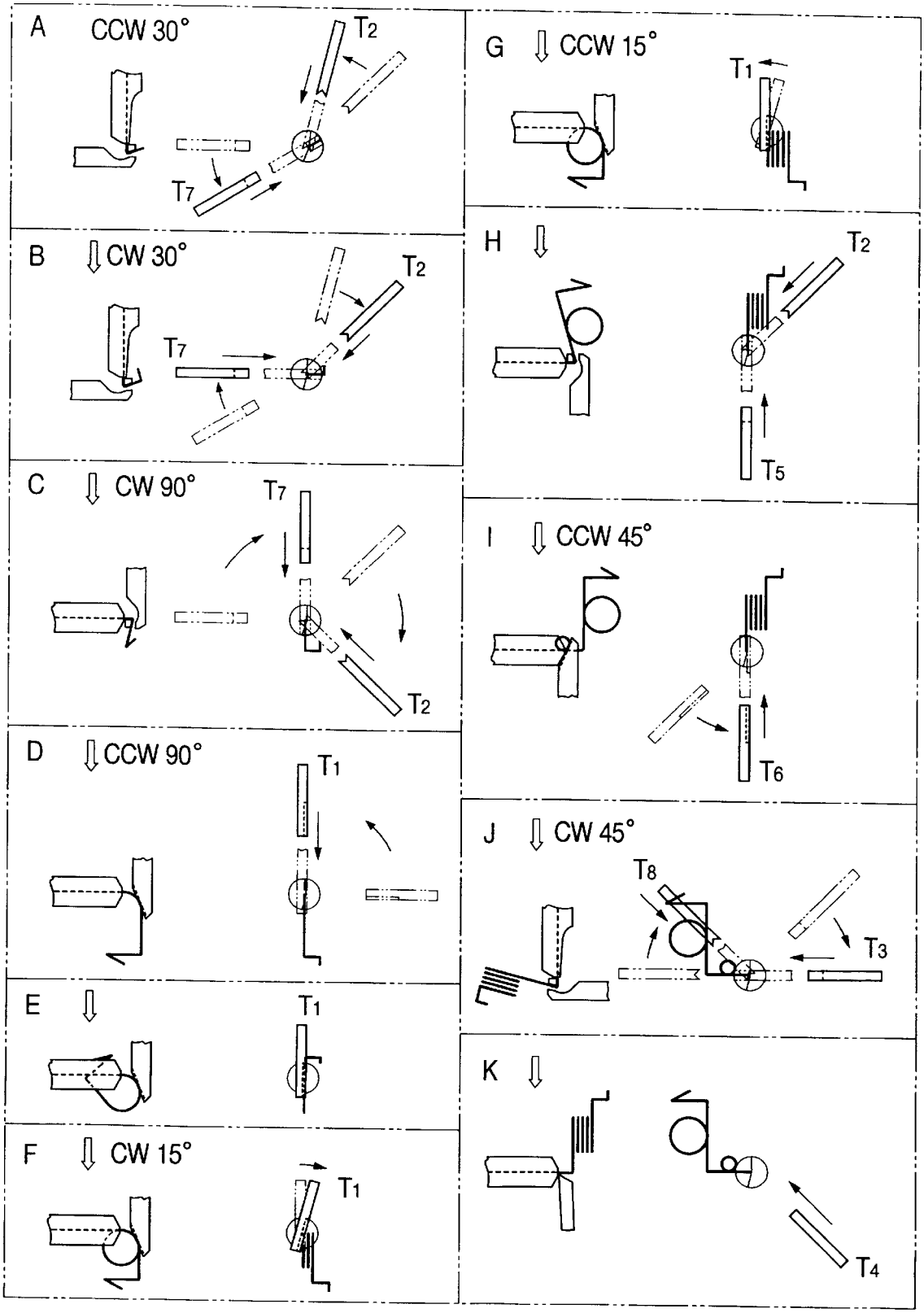
FIGS. 13A to 13K are views showing the formation of the linear spring shown in FIG. 11.
Figure 14:
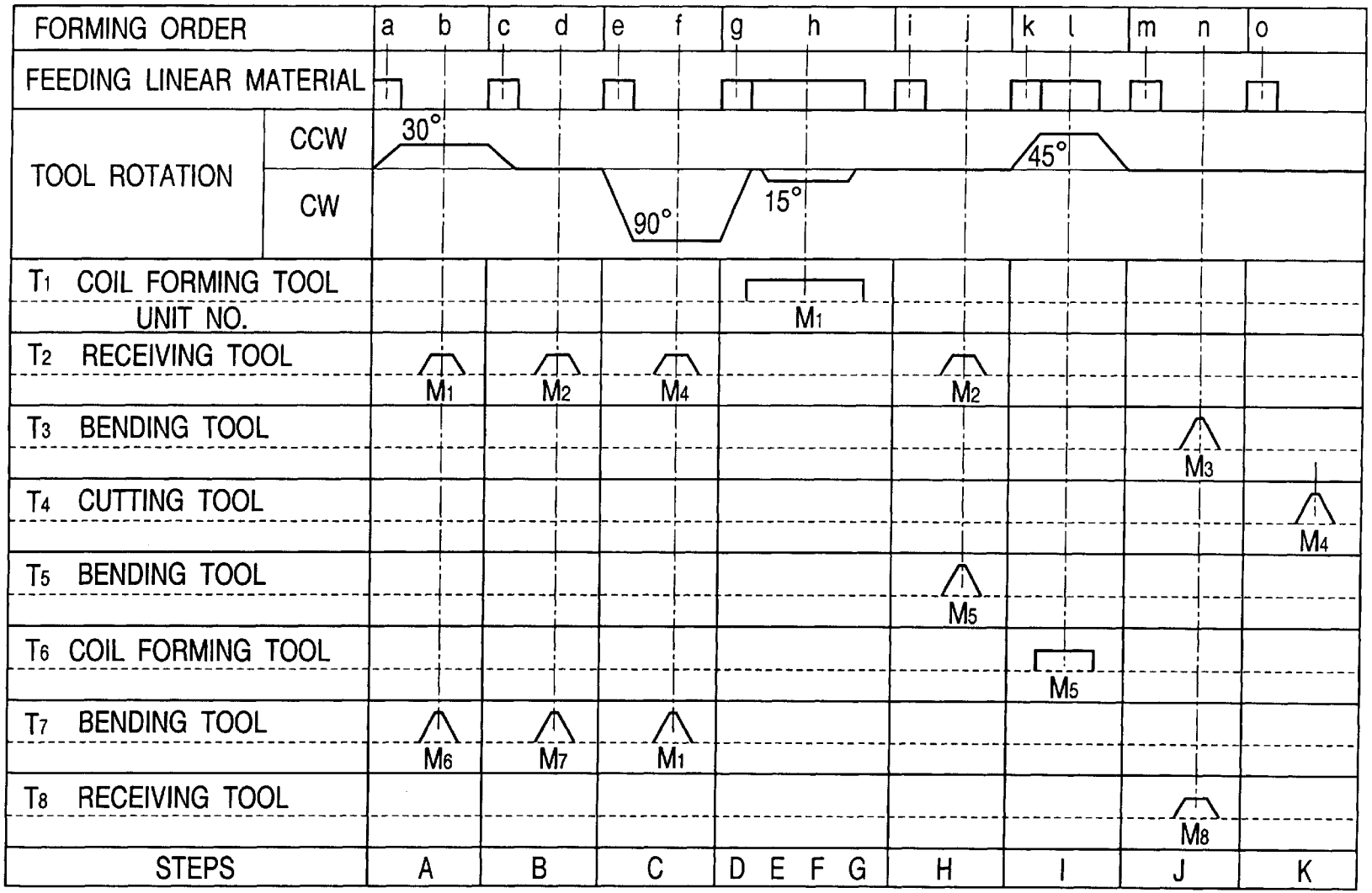
FIG. 14 is a view showing a time sharing table for the formation of the linear spring.

FIG. 11 is a perspective view showing one example of a linear spring to be formed. The order of formation starting from a portion "a" will be explained. FIG. 12 shows the arrangement of the forming tools before formation. $T_1$ and $T_6$ denote coil forming tools, $T_2$ and $T_8$ denote receiving tools, $T_3$, $T_5$ and $T_7$ denote bending tools, and $T_4$ denotes a cutting tool. These four kinds of tools are in accordance with the conventional technique. The quill 6 is fixed to the upper base 2. In FIG. 12, $M_1$ to $M_8$ are addresses (allotting number) of the arcuate cam unit 31 (hereinafter simply referred to as a unit). FIGS. 13A to 13K are views showing the formation steps including the eleven steps A to K. Incidentally, FIG. 14 shows a time sharing table when the linear spring shown in FIG. 11 is to be formed.

First, in the case where the drive source mounting table 2' is disposed rotatably within a predetermined angle range about the centerline of the quill 6 outside of the turntable 10, the drive source mounting table 2' is positioned and fixed by the nuts 2*b* by limiting the rotational angular range. Then, in step A, the servo motor 12 of the first drive means is driven to thereby rotate the turntable 10 counterclockwise through 30°. During the rotation, the linear material 41 is fed by the operation of the servo motor 4 of the third drive means by a length corresponding to the portion "a". Subsequently, the receiving tool $T_2$ and the bending tool $T_7$ operated by the units $M_1$ and $M_6$ through the drive of the two servo motors 34 of the second drive means are advanced together to come into contact with the linear material 41. When the bending portion "b" is formed, the two tools $T_2$ and $T_7$ are retracted.

Subsequently, as shown in step B, the servo motor 12 of the first drive means is driven to rotate the turntable 10 clockwise through 30°. Meanwhile the servo motor 4 of the third drive means is driven to thereby feed the linear material 41 by a length corresponding to the portion "c". Subsequently, the receiving tool $T_2$ and the bending tool $T_7$ operated by the units $M_2$ and $M_7$ through the drive of the two servo motors 34 of the second drive means are advanced together to come into contact with the linear material 41. When the bending portion "d" is formed, the two tools $T_2$ and $T_7$ are retracted.

Subsequently, as shown in step C, the servo motor 12 of the first drive means is driven so that the turntable 10 is rotated clockwise through 90°. Meanwhile the linear material 41 is fed by a length corresponding to the portion "e" by the driving motion of the servo motor 4 of the third drive means. Subsequently, the receiving tool $T_2$ and the bending tool $T_7$ operated by the units $M_4$ and $M_1$ through the drive of the two servo motors 34 of the second drive means are advanced together to come into contact with the linear material 41. When the bending portion "f" is formed, the two tools $T_2$ and $T_7$ are retracted.

Subsequently, as shown in step D, the servo motor 12 of the first drive means is driven so that the turntable 10 is rotated counterclockwise through 90°. Meanwhile the linear material 41 is fed by a length corresponding to the portion "g" by driving motion of the servo motor 4 of the third drive means. Subsequently, when the coil forming tool $T_1$ operated by the unit $M_1$ through the drive of the servo motor 34 of the second drive means is advanced to come into contact with the linear material 41, the feed of the linear material 41 is started and the formation of the coil portion "h" is started. As shown in step E, when the feed of the linear material 41 is continued by the drive of the servo motor 4 of the third drive means to form a seat coil for the coil portion "h", the servo motor 12 of the first drive means is driven under the condition that, as shown in step F, the feed of the linear material 41 is continued by the drive of the servo motor 4 of the third drive means. As a result, the turntable 10 is rotated clockwise through 15° so that the pitch formation for the coil portion "h" is started by the coil forming tool $T_1$.

When the pitch formation for the coil portion "h" is completed, the drive of the servo motor 4 of the third drive means is stopped to finish the feed of the linear material 41. As shown in step G, when the servo motor 12 of the first drive means is driven so that the turntable 10 is rotated counterclockwise through 15°, the feed of the linear material 41 is started by the drive of the servo motor 4 of the third drive means to form a seat coil. Then, the drive of the servo motor 4 of the third drive means is stopped, the feed of the linear material 41 is stopped, and the coil forming tool $T_1$ operated by the unit $M_1$ through the drive of the servo motor 34 of the second drive means is retracted.

Subsequently, as shown in step H, under the condition that the servo motor 12 of the first drive means is not driven, the linear material 41 is fed by a length corresponding to the portion "i" by the drive of the servo motor 4 of the third drive means. The receiving tool $T_2$ and the bending tool $T_5$ operated by the units $M_2$ and $M_5$ through the drive of the two servo motors 34 of the second drive means are advanced together to come into contact with the linear material 41. When the bending portion "j" is formed, the two tools $T_2$ and $T_5$ are retracted.

Subsequently, as shown in step I, the servo motor 12 of the first drive means is driven so that the turntable 10 is rotated counterclockwise through 45°. Meanwhile the linear material 41 is fed by a length corresponding to the portion "k" by the servo motor 4 of the third drive means. Subsequently, when the coil forming tool $T_6$ operated by the unit $M_5$ through the drive of the servo motor 34 of the second drive means is advanced to come into contact with the linear material 41, and the feed of the linear material 41 is continued by the drive of the servo motor 4 of the third drive means so that the coil portion "1", is formed. Then the feed of the linear material 41 is stopped and the coil forming tool $T_6$ is retracted.

Subsequently, as shown in step J, the servo motor 12 of the first drive means is driven so that the turntable 10 is rotated clockwise through 45°. Meanwhile the linear material 41 is fed by a length corresponding to the portion "m" by the driving motion of the servo motor 4 of the third drive means. Subsequently, the receiving tool $T_8$ and the bending tool $T_3$ operated by the units $M_8$ and $M_3$ through the drive of the two servo motors 34 of the second drive means are advanced together to come into contact with the linear material 41. When the bending portion "n" is formed, the two tools $T_8$ and $T_3$ are retracted.

Finally, as shown in step K, under the condition that the servo motor 12 of the first drive means is not driven, the linear material 41 is fed by a length corresponding to the portion "o" by the drive of the servo motor 4 of the third drive means. The cutting tool $T_4$ operated by the unit $M_4$ by the drive of the servo motor 34 of the second drive means is advanced to cut the linear material 41. Then, the cutting tool $T_4$ is retracted. The linear spring that has been formed in the shape as shown in FIG. 11 is to drop.

Figure 15:
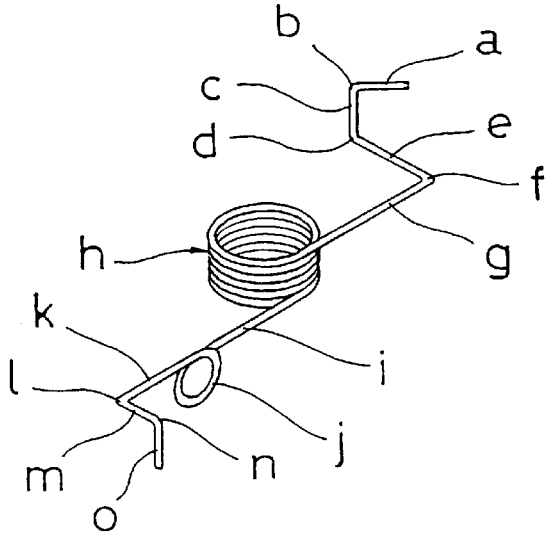
FIG. 15 is a perspective view showing another example of a linear spring to be formed by the apparatus according to the invention.
Figure 16:
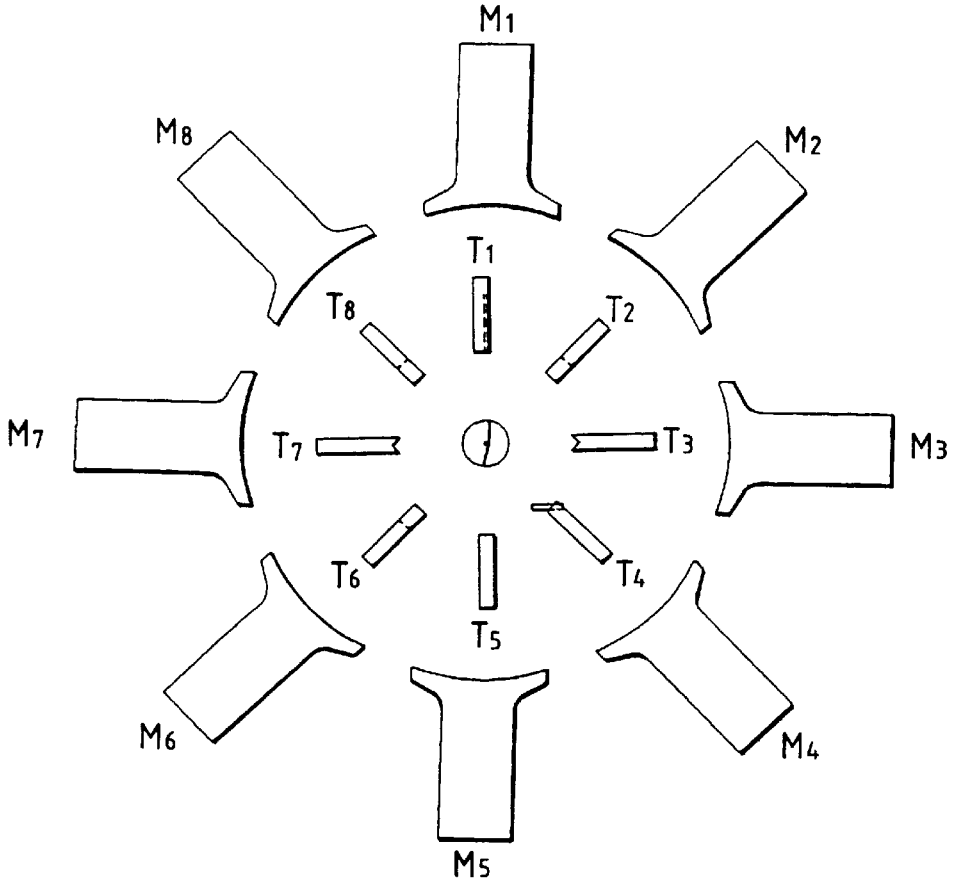
FIG. 16 is a view showing an arrangement of the forming tools before the formation of the linear spring shown in FIG. 15.
Figure 17:
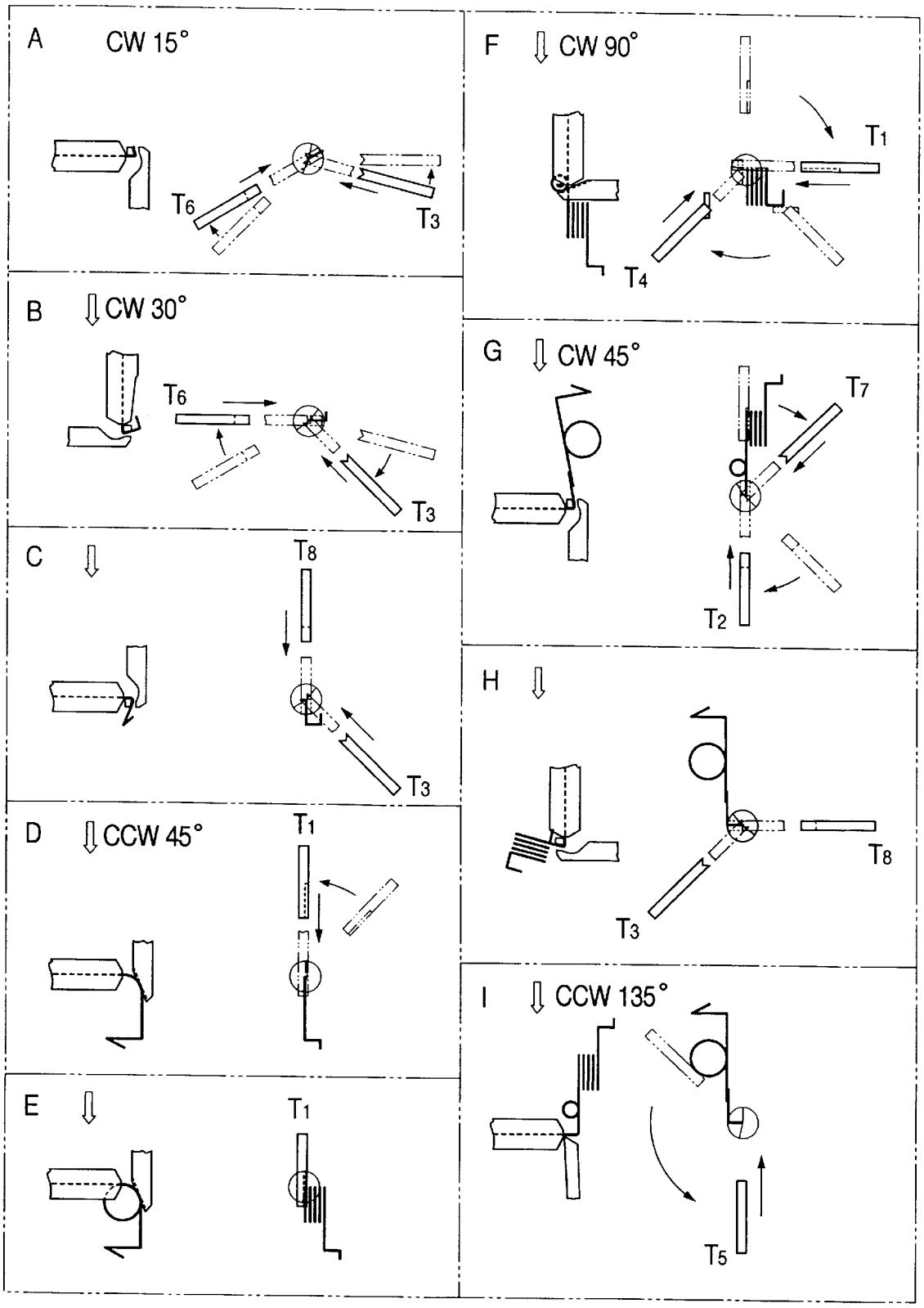
FIGS. 17A to 17I are views showing the formation of the linear spring shown in FIG. 15.
Figure 18:
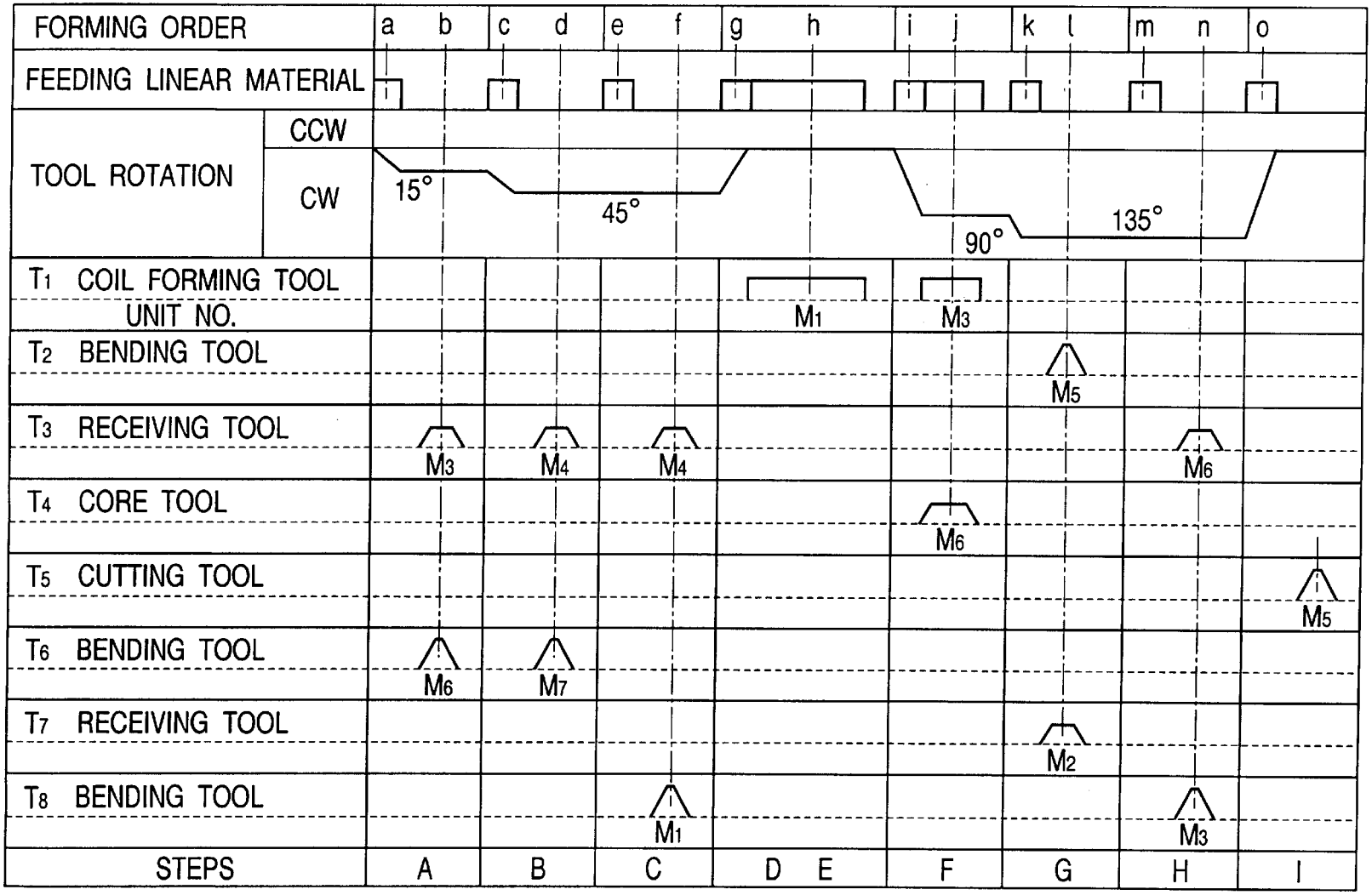
FIG. 18 is a view showing a time sharing table for the formation of the linear spring.
Figure 19:
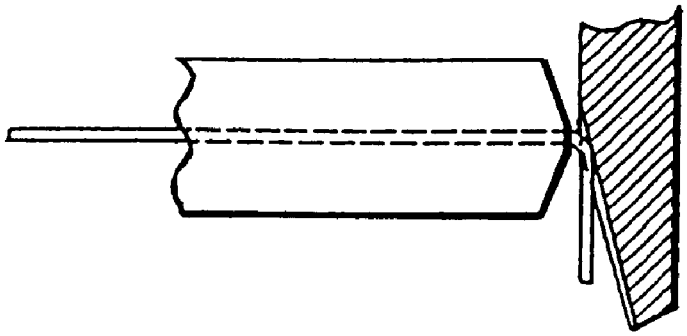
FIG. 19 is a view showing a state of bending the linear material in a conventional apparatus in which a single forming tool is used for forming all the steps.
Figure 20:
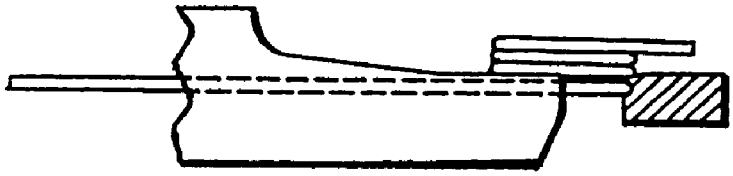
FIG. 20 is a view showing a quill in the conventional apparatus in which a single forming tool is used for forming all the steps.

Also, FIG. 15 is a perspective view showing another example of a linear spring to be formed. The order of formation starting from the portion "a" will be explained. FIG. 16 shows the arrangement of the forming tools before formation. $T_1$ denotes a coil forming tool, $T_2$, $T_6$ and $T_8$ denote bending tools, $T_3$, and $T_7$ denote receiving tools, $T_4$ denotes a core tool and $T_5$ denotes a cutting tool. These five kinds of tools are made in accordance with the conventional technique. The quill 6 is rotated in cooperation with the turntable 10. In FIG. 16, $M_1$ to $M_8$ are addresses (allotting number) of the arcuate cam unit 31. FIGS. 17A to 17I are views showing the formation steps including the nine steps A to I. Incidentally, FIG. 18 shows a time sharing table when the linear spring shown in FIG. 15 is to be formed.

First of all, in the case where the drive source mounting table 2' is disposed rotatably within a predetermined angle range about the centerline of the quill 6 outside of the turntable 10, the drive source mounting table 2' is positioned and fixed by the nuts 2*b* by limiting the rotational angular range. Then, in step A, the servo motor 12 of the first drive means is driven to thereby rotate the turntable 10 clockwise through 15°. During the rotation, the linear material 41 is fed by the operation of the servo motor 4 of the third drive means by a length corresponding to the portion "a". Subsequently, the receiving tool $T_3$ and the bending tool $T_6$ operated by the units $M_3$ and $M_6$ through the drive of the two servo motors 34 of the second drive means are advanced together to come into contact with the linear material 41. When the bending portion "b" is formed, the two tools $T_3$ and $T_6$ are retracted.

Subsequently, as shown in step B, the servo motor 12 of the first drive means is driven to rotate the turntable 10 clockwise through 30°. Meanwhile the servo motor 4 of the third drive means is driven to thereby feed the linear material 41 by a length corresponding to the portion "c". Subsequently, the receiving tool $T_3$ and the bending tool $T_6$ operated by the units $M_4$ and $M_7$ through the drive of the two servo motors 34 of the second drive means are advanced together to come into contact with the linear material 41. When the bending portion "d" is formed, the two tools $T_3$ and $T_6$ are retracted.

Subsequently, as shown in step C, under the condition that the servo motor 12 of the first drive means is not driven, the linear material 41 is fed by a length corresponding to the portion "e" by the drive of the servo motor 4 of the third drive means. The receiving tool $T_3$ and the bending tool $T_8$ operated by the units $M_4$ and $M_1$ through the drive of the two servo motors 34 of the second drive means are advanced together to come into contact with the linear material 41. When the bending portion "f" is formed, the two tools $T_3$ and $T_8$ are retracted.

Subsequently, as shown in step D, the servo motor 12 of the first drive means is driven so that the turntable 10 is rotated counterclockwise through 45°. Meanwhile the linear material 41 is fed by a length corresponding to the portion "g" by the servo motor 4 of the third drive means. Subsequently, when the coil forming tool $T_1$ operated by the unit $M_1$ through the drive of the servo motor 34 of the second drive means is advanced to come into contact with the linear material 41, the feed of the linear material 41 is started by the drive of the servo motor 4 of the third drive means to thereby start the formation of the coil portion "h". As shown in step E, when the feed of the linear material 41 is continued to form the intimate wound main coil portion "h", the drive of the servo motor 34 of the second drive means is stopped. The feed of the linear material 41 is stopped, and the coil forming tool $T_1$ is retracted.

Subsequently, as shown in step F, the servo motor 12 of the first drive means is driven so that the turntable 10 is rotated clockwise through 90°. Meanwhile the linear material 41 is fed by a length corresponding to the portion "i" by the servo motor 4 of the third drive means. Subsequently, when the core tool $T_4$ operated by the unit $M_6$ through the drive of the two servo motors 34 of the second drive means is advanced to come into light contact with the linear material 41 on the quill 6 side. Thereafter, the coil forming tool $T_1$ operated by the unit $M_3$ is advanced to come into contact with the linear material 41 at a position slightly remote from the quill 6. Then, the feed of the linear material 41 is started by the drive of the servo motor 4 of the third drive means and the two tools of the core tool $T_4$ and the coil forming tool $T_1$ are brought into contact with each other so that the formation of the coil portion "j" having a small diameter is started. When the formation of the coil portion "j" is completed, the drive of the servo motor 34 of the second drive means is stopped and the feed of the linear material 41 is stopped. Then, the two tools $T_4$ and $T_1$ are retracted. In the circumstance, since the quill 6 is moved in cooperation with the rotation of the forming tool through 90°, the axis of the main coil portion "h" is formed at 90° with respect to the axis of the coil portion "j".

Subsequently, as shown in step G, the servo motor 12 of the first drive means is driven so that the turntable 10 is rotated clockwise through 45°. Meanwhile the linear material 41 is fed by a length corresponding to the portion "k" by the servo motor 4 of the third drive means. Subsequently, when the receiving tool $T_7$ and the bending tool $T_2$ operated by the units $M_2$ and $M_5$ through the drive of the two servo motors 34 of the second drive means are advanced to come into contact with the linear material 41, the bending portion "1" is formed and the two tools $T_7$ and $T_2$ are retracted.

Subsequently, as shown in step H, under the condition that the servo motor 12 of the first drive means is not driven, the linear material 41 is fed by a length corresponding to the portion "m" by the drive of the servo motor 4 of the third drive means. The receiving tool $T_3$ and the bending tool $T_8$ operated by the units $M_6$ and $M_3$ through the drive of the two servo motors 34 of the second drive means are advanced together to come into contact with the linear material 41. When the bending portion "n" is formed, the two tools $T_8$ and $T_3$ are retracted.

Finally, as shown in step I, the servo motor 12 of the first drive means is driven so that the turntable 10 is rotated counterclockwise through 135°. Meanwhile the linear material 41 is fed by a length corresponding to the portion "o" by the servo motor 4 of the third drive means. The cutting tool $T_5$ operated by the unit $M_5$ by the drive of the servo motor 34 of the second drive means is advanced to cut the linear material 41. Then, the cutting tool $T_5$ is retracted. The linear spring that has been formed in the shape as shown in FIG. 15 is to drop.

As described above in detail, a plurality of different kinds of forming tools (four or five kinds in the description of the embodiment, which are generally standard tools) are arranged with some limitation and are rotated about the quill, and a single or a desired number of different kinds of tools are advanced in an optimum direction for forming the linear material to thereby perform a positive formation of the linear material. In other words, it is possible to advance the forming tools, that are different in type, in exactly the same direction or substantially the same direction. Theoretically, it is possible to cope with the formation in any angle over 360°.

Thus, according to the present invention, it is possible to completely dispense with any adjustment means for an unapplicable formation angle and any unfeasible bending means due to a difference between the direction in which the linear material is formed and the direction in which the forming tool is advanced as in the conventional technology. In addition, it is possible to cut the linear material, that has been formed, in an optimum direction. Accordingly, the present invention is advantageous in comparison with the prior art in the following points.

According to a first aspect of the invention, since a single or a plurality of forming tools which are most suitable for the formation of the linear spring may be advanced in a direction most suitable for the formation of the linear material to thereby perform the positive formation of the linear spring, the preparation work for the production of the linear spring may be simplified and very easy. Not only a time for the preparation work may be saved but also the technical elements or steps for the preparation work are simplified. Accordingly, a not skilled person may perform the preparation of the linear spring in any desired shape.

According to a second aspect of the invention, it is possible not only to form the linear spring having a shape which has not been able to be attained according to the prior art but also to facilitate the formation of the spring set at a low production rate due to the high requirement of the precision. Needless to say, it is possible to sufficiently enhance the production rate according to the invention.

A third aspect is as follows. Namely, recently, there have been strong demands for mass production or very small amount of the production for various linear springs. In this case, even if the number of the forming steps is large and the shape of the linear spring is very complicated, according to the present invention, it is sufficient to use only one kind of the tools for this requirement. It is possible to form the linear spring in exactly the same manner as that of the mass production. The preparation work is very simplified.

A fourth aspect is as follows. In general, if the quill to be used in a stationary position may be made rotatable in cooperation with the rotation of the forming tools, it is possible to much simplify the formation of the linear spring having a complicated shape like a composite coil spring having a plurality of coil portions.

According to a fifth aspect, when the linear material is bent, the formation is completely free from the adverse affect of the edge of the linear material outlet of the quill, and it is not necessary to perform the advance of the forming tool while twisting the linear material and the following alignment in timing with auxiliary tools. Accordingly, it is possible to rather enhance the advance and retraction speed of the forming tool. It is therefore possible to set the forming speed of the linear spring to a high level.

According to a sixth aspect, although the rotation of the turntable on which the forming tools are mounted has to be at performed during the formation, it is possible to eliminate the adverse affect of the rotation time by feeding the linear material or retracting or advancing the tools during the rotation of the turntable. The productivity is enhanced in combination with the above-described five aspects.

According to a seventh aspect, even if the turntable on which the forming tools are mounted is rotated about the centerline of the quill, there is no change in relationship with the centerline of the quill between any two forming tools. Accordingly, for instance, in the case where a plurality of forming tools for bending the linear material are used, it is possible to perform the formation by constantly using the same combination of the forming tools. Accordingly, it is possible to maintain the high forming precision as well as the easy preparation as described above.

According to an eighth aspect, if the number of the forming tools to be arranged radially about the centerline of the quill is increased so that a plurality of the same kinds of forming tools are arranged, even in the case where the same formation is performed, the forming tools located within the rotational angle for the formation are used to thereby shorten the rotation time. This effect is remarkable in the case where the drive source mounting table that is rotatable within a predetermined angle about the centerline of the quill is arranged outside of the turntable.

As described above, the industrial effects of the method and apparatus for forming the linear springs according to the present invention are remarkable.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What we claim is:

1. A method for forming a linear spring, including the steps of: advancing three or more forming tools, arranged radially about a centerline of a quill for guiding a linear material, in an extension direction of the centerline of the quill, perpendicular or substantially perpendicular to the centerline of the quill, and colliding the forming tools to the linear material fed from a tip end portion of the quill, said method characterized by comprising the following steps of:

rotating a turntable, on which the forming tools are mounted, about the centerline of the quill so that a linear material contact surface of at least one, as desired, of the forming is located in a direction which is suitable for the formation of the linear material; and after said rotating, advancing the forming tool, as desired, in the extension direction of the centerline through an associated one of a number of driving means, the number being more than the number of the forming tools arranged, disposed radially about the centerline of the quill outside of the turntable for forming the linear spring.

2. The method according to claim 1, wherein the quill is rotated about the centerline of the quill.

3. The method according to claim 1 or 2, wherein the linear material is fed from the tip end portion of the quill in a step for rotating the turntable, on which the respective forming tools are mounted, about the centerline of the quill so, that the linear material contact surface of a desired one or plural forming tools is located in a direction suitable for the formation of the linear material.

4. An apparatus for forming a linear spring, in which three or more forming tools, arranged radially about a centerline of a quill for guiding a linear material, are advanced in an extension direction of the centerline of the quill, perpendicular or substantially perpendicular to the centerline of the quill, and the forming tools are collided against the linear material fed from a tip end portion of the quill, said apparatus characterized by comprising:

a first drive means for rotating a turntable, to which are respective track rails for slidingly advancing and retracting slide units, having the forming tools, in the extension direction of the centerline of the quill, perpendicular or substantially perpendicular to the centerline of the quill;

a number of second drive means, said number being equal to or greater than the number of the slide units, said second drive means being disposed radially about the centerline of the quill outside of the turntable for advancing and retracting the desired slide units in the extension direction of the centerline of the quill; and a third drive means for feeding the linear material from the tip end portion of the quill;

wherein said first drive means and said second drive means are controlled in synchronism with said third drive means.

5. The apparatus according to claim 4, wherein the quill is supported rotatable about the centerline of the quill, and is switchable between a case where the quill is fixed through a coupling member in an unrotatable condition and a case where the quill is coupled with the turntable through another coupling member to be rotated together with the turntable.

6. The apparatus according to claim 4 or 5, wherein a drive source for the second drive means is located outside of the turntable, and is mounted on a drive source mounting table that is rotatable within a predetermined angle range about the centerline of the quill.

7. The apparatus according to any one of claims 4 to 6, wherein said second drive means is provided with an arcuate cam that is advancable and retractable in the extension direction of the centerline of the quill, and a center of curvature of an inner surface of the arcuate cam is set substantially on the centerline of the quill when a cam follower provided in the slide unit is moved closest to the quill under the condition the cam follower is brought into contact with the inner surface of the arcuate cam.

8. The apparatus according to claim 7, wherein the arcuate cam may be spliced at its end portion with an auxiliary cam.

* * * * *

UNITED STATES PATENT AND TRADEMARK OFFICE

CERTIFICATE OF CORRECTION

PATENT NO. : 5,937,685

DATED : August 17, 1999

INVENTOR(S): Takeji MATSUOKA, et al.

It is certified that an error appears in the above-identified patent and that said Letters Patent is hereby corrected as shown below:

Column 15, line 28, change "forming is located" to --forming tools is located--

Column 15, line 43, change "mounted, about" to --mounted about--

Column 16, line 7, change "which are respective" to --which are fixed respective--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*